US010501954B2

(12) United States Patent
Collier

(10) Patent No.: US 10,501,954 B2
(45) Date of Patent: Dec. 10, 2019

(54) SONIC POOL BRUSH

(71) Applicant: Michael Andrew Collier, Glendale, AZ (US)

(72) Inventor: Michael Andrew Collier, Glendale, AZ (US)

( * ) Notice: Subject to any disclaimer, the term of this patent is extended or adjusted under 35 U.S.C. 154(b) by 22 days.

(21) Appl. No.: 16/027,165

(22) Filed: Jul. 3, 2018

(65) Prior Publication Data

US 2019/0010721 A1 Jan. 10, 2019

Related U.S. Application Data

(60) Provisional application No. 62/528,954, filed on Jul. 5, 2017.

(51) Int. Cl.
*E04H 4/16* (2006.01)
*A46B 13/02* (2006.01)

(52) U.S. Cl.
CPC ..... *E04H 4/1618* (2013.01); *A46B 13/023* (2013.01); *A46B 2200/3073* (2013.01)

(58) Field of Classification Search
CPC combination set(s) only.
See application file for complete search history.

(56) References Cited

U.S. PATENT DOCUMENTS

2002/0067084 A1* 6/2002 Jung ..... H02P 7/00 310/50
2005/0211612 A1* 9/2005 Mattson, Jr. ..... A61H 33/0087 210/167.11

* cited by examiner

*Primary Examiner* — Eric W Golightly
(74) *Attorney, Agent, or Firm* — Parsons & Goltry; Robert Parsons; Michael Goltry

(57) ABSTRACT

A sonic pool brush including a head assembly with a base having a plurality of electric motors/circuits mounted on an upper surface and a plurality of brush segments positioned in a row along the lower surface of the base. The brush segments connected one each to the electric motors/circuits, for oscillating motion of each individual brush segment when the plurality of electric motors/circuits are energized, each individual brush segment oscillating at a rate in the sonic range. A housing constructed to fit over the motors and engage the base in a waterproof arrangement and a source of electric power attachable to the plurality of electric motors/circuits for energizing the plurality of electric motors/circuits.

17 Claims, 4 Drawing Sheets

SONIC POOL BRUSH

CROSS-REFERENCE TO RELATED APPLICATION

This application claims the benefit of U.S. Provisional Patent Application No. 62/528,954, file 5 Jul. 2017.

FIELD OF THE INVENTION

This invention relates to swimming pool brushes and more specifically to powered pool brushes.

BACKGROUND OF THE INVENTION

Swimming pools are work intensive and, in particular, require regular brushing to circulate accumulated foreign materials so they can be filtered out of the pool and to prevent the growth of algae and the like. Brushing with the standard pool brush generally does not result in completely removing or "stirring-up" materials clinging to the sides and bottom of the pool. In many instances the brush, in a continuous movement, simply skims over the material leaving it still clinging to the side or bottom. Applying sufficient downward pressure to the brush as it is moved across the surface can be extremely fatiguing to the operator and, in many cases, still does not remove or stir-up the offending material. Further, applying downward pressure to the brush is literally impossible in some areas of the pool, such as the center.

It would be highly advantageous, therefore, to remedy this and other deficiencies inherent in the prior art.

Accordingly, it is an object of the present invention to provide a new and improved pool brush.

It is another object of the present invention to provide a new and improved pool brush that is powered to quickly and easily remove or stir-up foreign materials from the sides and bottom of a swimming pool with little or no downward pressure.

SUMMARY OF THE INVENTION

Briefly, to achieve the desired objects of the instant invention in accordance with a preferred embodiment thereof, a sonic pool brush is described that includes a head assembly with a base having an electric motor/circuit mounted on an upper surface and a brush segment positioned along the lower surface of the base. The brush segment is connected to the electric motor/circuit, for oscillating motion of the brush segment when the electric motor/circuit is energized, the brush segment oscillating at a rate in the sonic range. A housing is constructed to fit over the electric motor/circuit and engage the base in a waterproof arrangement and a source of electric power is attachable to the electric motor/circuit for energizing the electric motor/circuit.

The desired objects of the instant invention are further achieved in accordance with a specific embodiment of a sonic pool brush including a head assembly with a base having a plurality of electric motors/circuits mounted on an upper surface. An equal plurality of brush segments is positioned in a row along the lower surface of the base and connected one each to the electric motors/circuits for oscillating motion of each individual brush segment when the plurality of electric motors/circuits are energized. Each individual brush segment includes bristles having a length in a range of one/half inch to two and one/half inches and each individual brush segment vibrates at a rate in a range of 20 Hz to 20,000 Hz when the electric motors/circuits are energized. A housing is constructed to fit over the motors and engage the base in a waterproof arrangement and an extendable handle is attached to the head assembly. One of a battery pack or a battery is attachable to the plurality of electric motors/circuits for energizing the plurality of electric motors/circuits.

The desired objects of the instant invention are further achieved in accordance with a method of cleaning a swimming pool comprising the steps of: providing a sonic pool brush including a head assembly with a base having a plurality of electric motors/circuits mounted on an upper surface and a plurality of brush segments positioned in a row along the lower surface of the base and connected one each to the electric motors/circuits, for oscillating motion of each individual brush segment when the plurality of electric motors/circuits are energized, each individual brush segment oscillating at a rate in the sonic range, a housing constructed to fit over the motors and engage the base in a waterproof arrangement, and a source of electric power attachable to the plurality of electric motors/circuits for energizing the plurality of electric motors/circuits; attaching the power source to the plurality of electric motors/circuits, energizing the plurality of electric motors/circuits; and moving the sonic pool brush over the sides and bottom of a swimming pool by holding or moving the brush segments near a surface of the pool without providing a downward pressure.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF THE DRAWINGS

Figure 1:
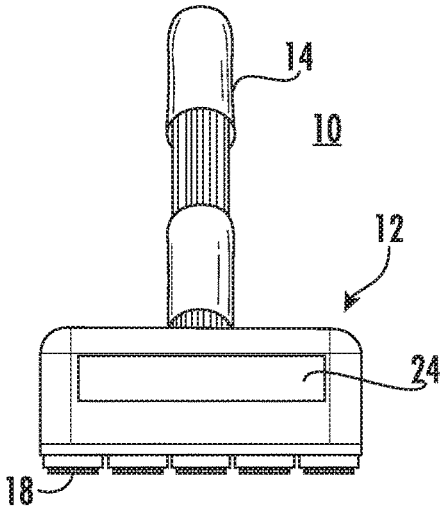
FIG. 1 is a top view of a pool brush in accordance with the present invention.
Figure 2:
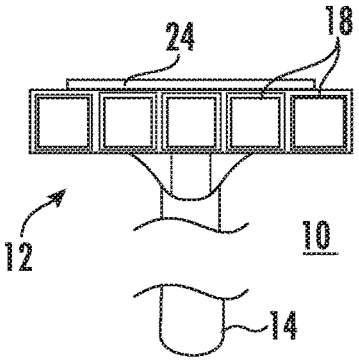
FIG. 2 is a bottom view of the pool brush illustrated in FIG. 1, portions thereof broken away.
Figure 3:
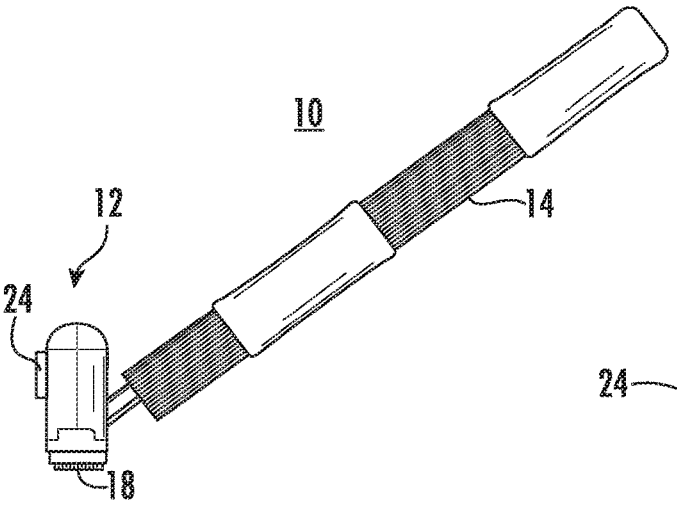
FIG. 3 is side view of the pool brush illustrated in FIG. 1.
Figure 4:
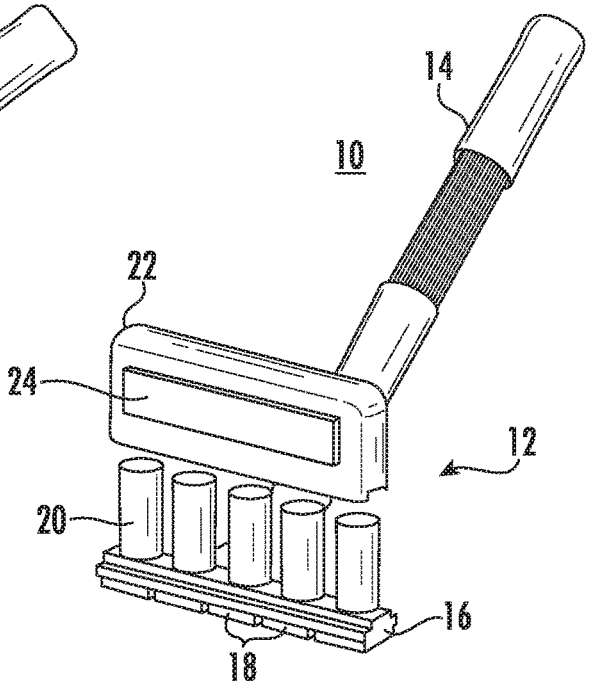
FIG. 4 is an exploded view of the pool brush illustrated in FIG. 1.

Turning to the drawings and specifically to FIGS. 1-3, a pool brush 10 is illustrated as an example of the present invention. Pool brush 10 includes a head assembly 12 with an extendable handle 14 attached thereto. Referring additionally to FIG. 4, it can be seen that head assembly 12 includes a base 16 having a plurality of electric motors/circuits 20 mounted in a row on the upper surface of base 16. Extendable handle 14 is preferably attached to base 16 of head assembly 12 for ruggedness in construction and use. A plurality of brush segments 18 positioned in a row along the lower surface of base 16 are connected, one each to electric motors/circuits 20 for oscillating motion. A housing 22 is constructed to fit over motors 20 and engage base 16 for example in a waterproof arrangement.

Motors/circuits 20 are battery operated and cause brush segments 18 to vibrate at a rate generally in the sonic range, which could be for example 20 Hz to 20,000 Hz. It will be understood that the sonic vibrations of brushes 18 cause not only a scrubbing action on the surface of the pool but also create a secondary cleansing action caused by bubbles and other turbulence, which is produced by the high rate of movement of the brush segment bristles. A main idea here is that the oscillating motion of the brush bristles produce a scrubbing and sonic cleaning action that quickly and easily removes foreign materials from the sides and bottom of a swimming pool with very little effort or downward pressure on the part of the operator.

In this embodiment, each brush segment 18 is attached to a separate very small, electric motor/electric circuit for simplicity of design and manufacture. Also, because the motor/circuits 20 are very small and light the final product will be light enough for an operator to easily manipulate at the end of extended handle 14. In some applications it may be desirable to provide greater or lesser numbers of brush segments 18 and the actual rate of the oscillating movement may vary or may even have more than one setting or mode.

In this embodiment, all motors/circuits 20 are powered by a single battery or battery pack 24 externally mounted on the front surface of housing 22. As will be understood by those of skill in the art, all individual components and the electrical connections may be waterproof or battery 24 and housing 22 may be waterproof to protect the entire head assembly 12 (except the brush segments). Also, there are many different methods and apparatus for energizing motors/circuits 20 with battery 24, the simplest being to plug battery 24 into a receptacle in housing 22 which then couples battery 24 directly to motors/circuits 20 and energizes them. While switches could be used they add cost, weight and additional waterproofing concerns.

Figure 5:
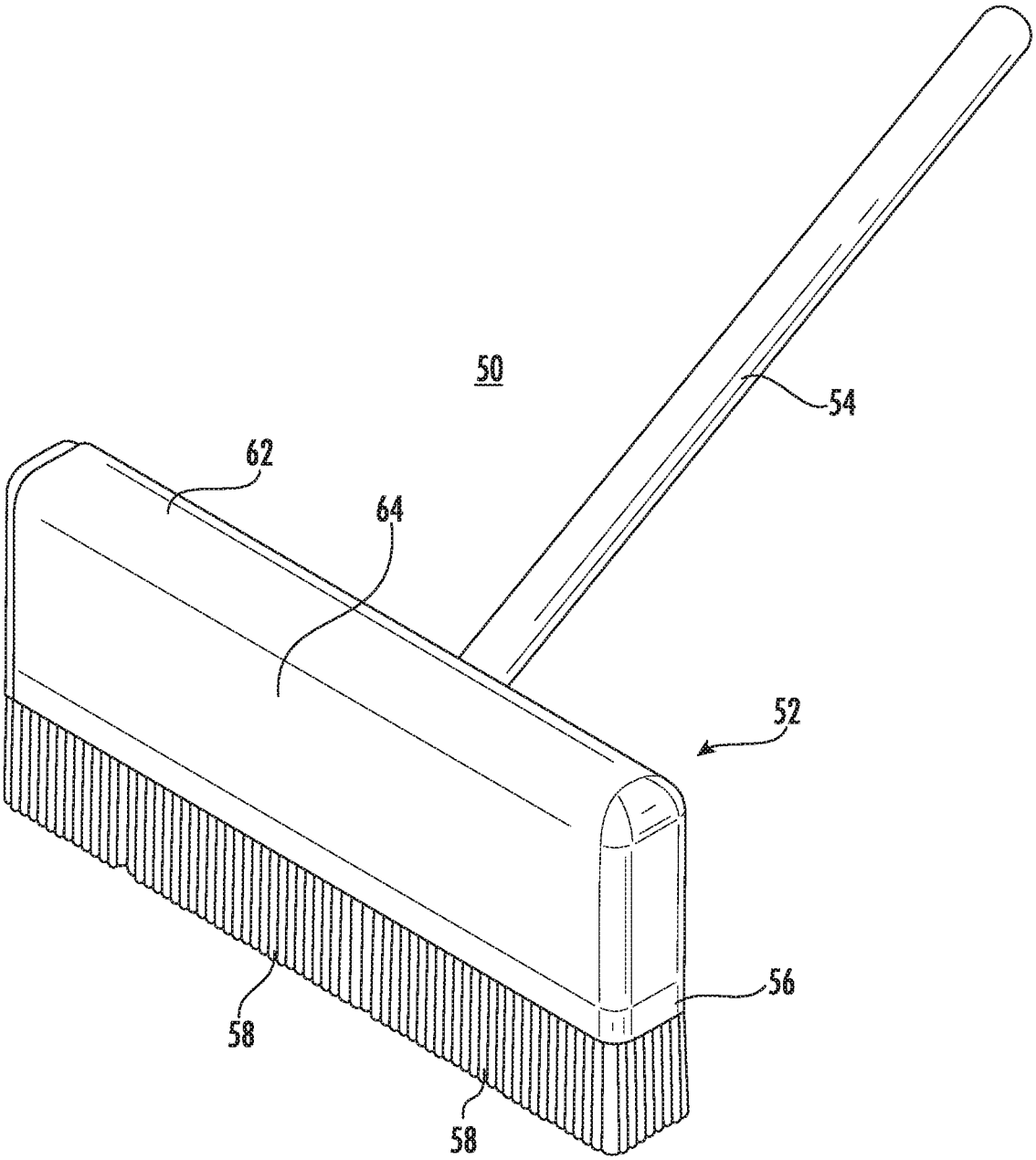
FIGS. 5, 6, and 7 are a view in perspective, a front view, and a side view, respectively, of a preferred embodiment of a sonic pool brush, in accordance with the present invention.
Figure 6:
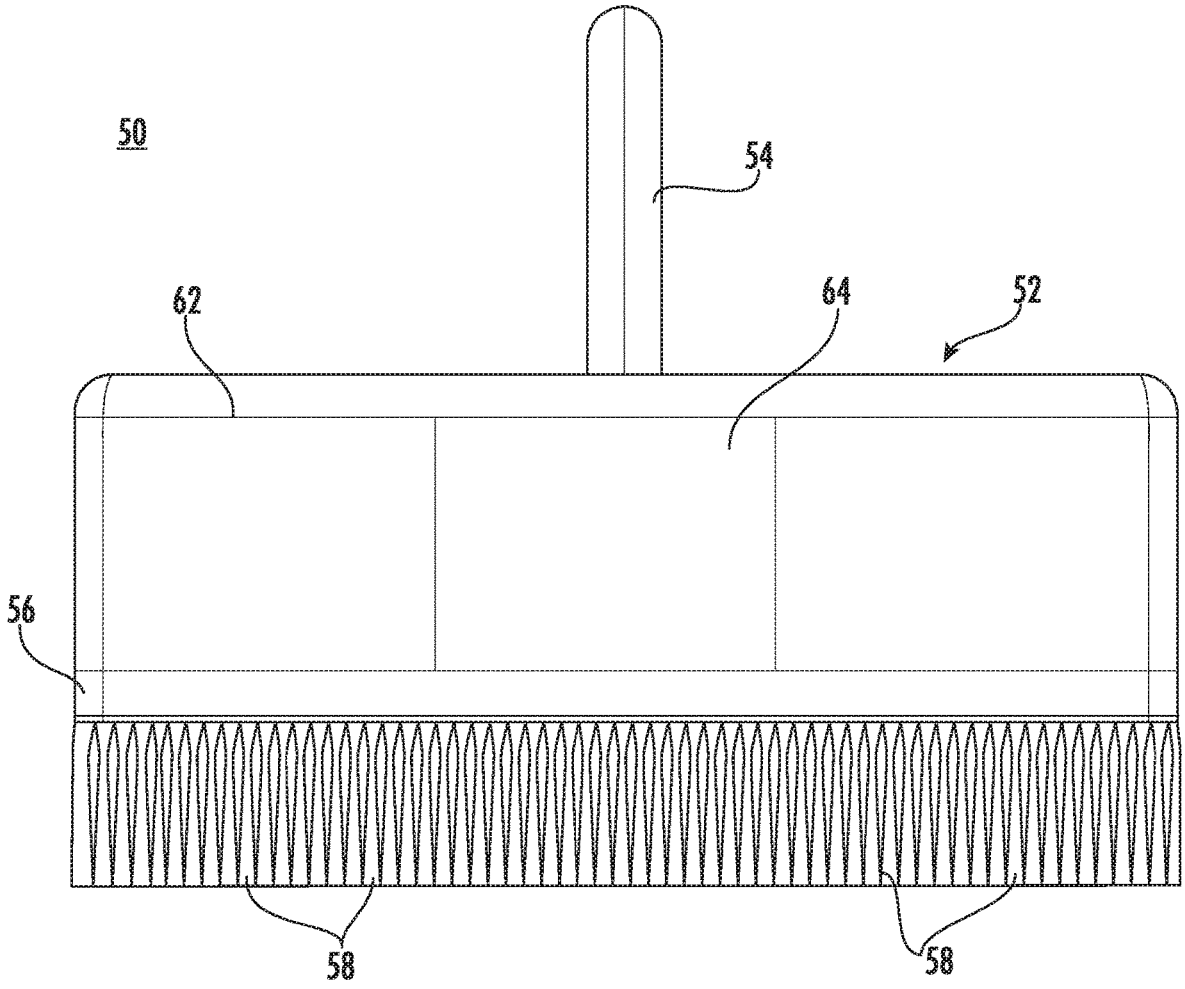
Figure 7:
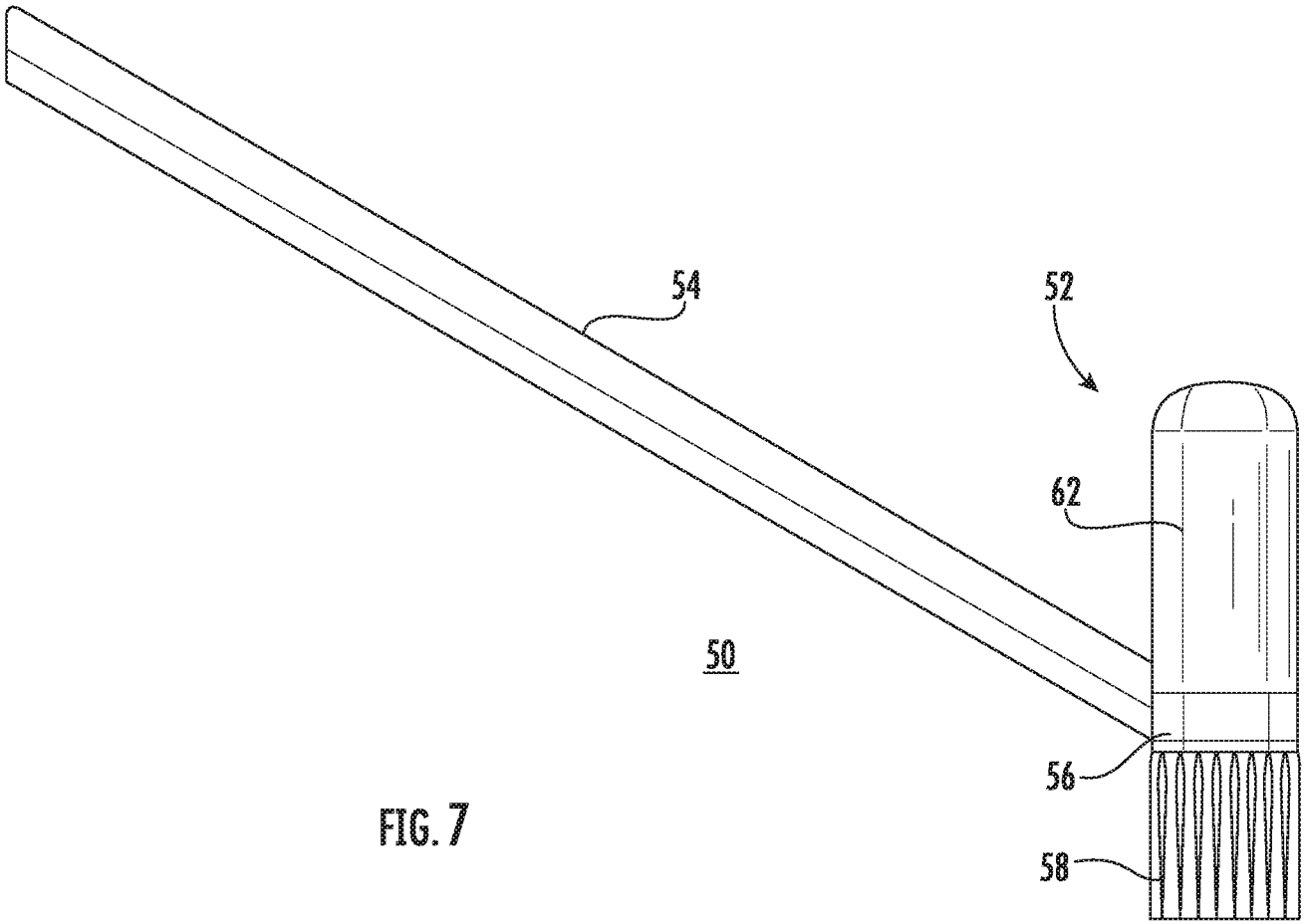

Turning to FIGS. 5, 6, and 7, a specific example of a preferred sonic pool brush 50 is illustrated. Pool brush 50 includes a head assembly 52 with an extendable handle 54 attached thereto. Head assembly 52 includes a base 56 which, as explained above, has a plurality of electric motors/circuits mounted in a row on an upper surface thereof. An equal plurality of brush segments 58 (equal to the number of electric motors/circuits in the plurality of electric motors/circuits) are positioned in a row along the lower surface of base 56 and connected, one each to the electric motors/circuits for oscillating motion. A housing 62 is constructed to fit over the motors and engage base 56 in a waterproof arrangement. All of the motors/circuits are powered by either a single battery or a battery pack 64 externally mounted on the front surface of housing 62. It will be understood that there are many different methods and apparatus for energizing the motors/circuits, the simplest as used in this embodiment is to plug battery 64 into a receptacle in housing 62 which then couples battery 64 directly to the motors/circuits and energizes them. When the cleaning is completed, battery 64 is simply unplugged and may be recharged or otherwise stored.

As explained above, the motors/circuits cause brush segments 58 to vibrate at a rate generally in the sonic range, which could be for example 20 Hz to 20,000 Hz. It will be understood that the sonic vibrations of brushes 58 cause not only a scrubbing action on the surface of the pool but also create a secondary cleansing action caused by bubbles and other turbulence, which is produced by the high rate of movement of the brush segment bristles. This secondary cleaning action is enhanced by the length of the bristles of brush segments 58 in this preferred embodiment. It has been determined, for example, that bristles in a range of one/half inch to two and one/half inches long (depending to some extent on the frequency of vibration) tend to enhance the secondary cleaning action. A main idea here is that the oscillating motion of the brush bristles produce a scrubbing and sonic cleaning action that quickly and easily removes foreign materials from the sides and bottom of a swimming pool with very little effort on the part of the operator.

It will be understood by those skilled in the art that in certain specific applications it may be possible to provide a single motor/circuit connected to one or more brush segments. In which case, the single motor/circuit would cause the entire brush segment or segments to vibrate at a sonic rate.

In the operating procedure of the novel sonic pool brush, a brush as described above is provided. A battery pack or battery is plugged into the electric receptacle in the housing assembly to energize the plurality of electric motors/circuits. The plurality of electric motors/circuits cause the brush segments to vibrate at a rate generally in the sonic range, which could be for example 20 Hz to 20,000 Hz. The oscillating brush segments quickly and easily remove or stir-up foreign materials from the sides and bottom of a swimming pool. Thus, any brushing action does not require downward pressure by the operator since the oscillating brush segments provide the cleaning action when they are held or moved near a surface of the pool.

Thus, the present invention discloses and provides a new and improved sonic pool brush. The new and improved pool brush includes sonic segments mounted for oscillating motion at sonic speeds to quickly and easily remove or stir-up foreign materials from the sides and bottom of a swimming pool. In its simplest and most practical form, the new and improved pool brush consists primarily of a head assembly housing a plurality of electric motor/circuits each attached to a brush segment mounted for sonic speed vibrational motion and a battery connected directly to the motors. Thus, any brushing action does not require downward pressure by the operator since the oscillating brush segments provide the cleaning action as long as they are held or moved near a surface of the pool.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A powered pool brush comprising:

a head assembly including a base having an electric motor/circuit mounted on an upper surface and a brush segment positioned along a lower surface of the base and connected to the electric motor/circuit, for oscillating motion of the brush segment when the electric motor/circuit is energized, the brush segment oscillating at a rate in the sonic range;

a housing constructed to fit over the electric motor/circuit and engage the base in a waterproof arrangement; and a source of electric power attachable to the electric motor/circuit for energizing the electric motor/circuit.

2. The sonic pool brush as claimed in claim 1 wherein the electric motor/circuit vibrates at a rate in a range of 20 Hz to 20,000 Hz.

3. The sonic pool brush as claimed in claim 1 wherein the brush segment includes bristles having a length in a range of one/half inch to two and one/half inches.

4. The sonic pool brush as claimed in claim 1 further including an extendable handle attached to the head assembly.

5. The sonic pool brush as claimed in claim 1 wherein the source of electric power includes one of a battery pack or a battery.

6. The sonic pool brush as claimed in claim 5 wherein the head assembly includes an electric receptacle attached directly to the electric motor/circuit and the one of the battery pack or the battery plugs into the electric receptacle which then couples the one of the battery pack or the battery directly to the electric motor/circuit.

7. A sonic pool brush comprising:

a head assembly including a base having a plurality of electric motors/circuits mounted on an upper surface;

an equal plurality of brush segments positioned in a row along a lower surface of the base and connected one each to the electric motors/circuits for oscillating motion of each individual brush segment when the plurality of electric motors/circuits are energized, each individual brush segment oscillating at a rate in the sonic range;

a housing constructed to fit over the motors/circuits and engage the base in a waterproof arrangement; and one of a battery pack or a battery attachable to the plurality of electric motors/circuits for energizing the plurality of electric motors/circuits.

8. The sonic pool brush as claimed in claim 7 wherein the plurality of electric motors/circuits vibrates at a rate in a range of 20 Hz to 20,000 Hz.

9. The sonic pool brush as claimed in claim 7 wherein the plurality of brush segments includes bristles having a length in a range of one/half inch to two and one/half inches.

10. The sonic pool brush as claimed in claim 7 further including an extendable handle attached to the head assembly.

11. The sonic pool brush as claimed in claim 7 wherein the head assembly includes an electric receptacle attached directly to the plurality of electric motors/circuits and the one of the battery pack or the battery plugs into the electric receptacle which then couples the one of the battery pack or the battery directly to the plurality of electric motors/circuits.

12. A method of cleaning a swimming pool comprising the steps of:

providing a sonic pool brush including a head assembly with a base having a plurality of electric motors/circuits mounted on an upper surface and a plurality of brush segments positioned in a row along a lower surface of the base and connected one each to the electric motors/circuits, for oscillating motion of each individual brush segment when the plurality of electric motors/circuits are energized, each individual brush segment oscillating at a rate in the sonic range, a housing constructed to fit over the motors/circuits and engage the base in a waterproof arrangement, and a source of electric power attachable to the plurality of electric motors/circuits for energizing the plurality of electric motors/circuits;

attaching the power source to the plurality of electric motors/circuits, energizing the plurality of electric motors/circuits; and moving the sonic pool brush over the sides and bottom of a swimming pool by holding or moving the brush segments near a surface of the pool without providing a downward pressure.

13. The method as claimed in claim 12 wherein the plurality of electric motors/circuits each vibrate at a rate in a range of 20 Hz to 20,000 Hz.

14. The method as claimed in claim 12 wherein the plurality of brush segments include bristles having a length in a range of one/half inch to two and one/half inches.

15. The method as claimed in claim 12 further including providing an extendable handle attached to the head assembly.

16. The method as claimed in claim 12 wherein the source of electric power includes one of a battery pack or a battery.

17. The method as claimed in claim 16 wherein the head assembly includes an electric receptacle attached directly to the plurality of electric motors/circuits and the one of the battery pack or the battery is plugged into the electric receptacle which then couples the one of the battery pack or the battery directly to the plurality of electric motors/circuits.

* * * * *